US011878202B2

(12) United States Patent
Cahn et al.

(10) Patent No.: US 11,878,202 B2
(45) Date of Patent: Jan. 23, 2024

(54) MODULAR POWER RACK ATTACHMENT FOR FACILITATING LOADED BARBELL HEIGHT ADJUSTMENT

(71) Applicant: BarMobil LLC, Jesup, GA (US)

(72) Inventors: Aaron David Cahn, Pepper Pike, OH (US); Madison Sierra Harrill, Jesup, GA (US); Emil Christopher Muly, Sandy Springs, GA (US); Trevor James Daino, Waxhaw, NC (US); Zachary Cole Elrod, Moreland, GA (US)

(73) Assignee: BARMOBIL LLC, Jesup, GA (US)

( * ) Notice: Subject to any disclaimer, the term of this patent is extended or adjusted under 35 U.S.C. 154(b) by 51 days.

(21) Appl. No.: 17/660,451

(22) Filed: Apr. 25, 2022

(65) Prior Publication Data

US 2022/0339486 A1 Oct. 27, 2022

Related U.S. Application Data

(60) Provisional application No. 63/201,366, filed on Apr. 26, 2021.

(51) Int. Cl.

| | |
|---|---|
| ***A63B 21/078*** | (2006.01) |
| ***A63B 21/00*** | (2006.01) |
| ***A63B 21/072*** | (2006.01) |

(52) U.S. Cl.

CPC ..... *A63B 21/078* (2013.01); *A63B 21/0724* (2013.01); *A63B 21/4045* (2015.10); *A63B 2225/093* (2013.01)

(58) Field of Classification Search

CPC ..... A63B 21/078; A63B 21/0726; A63B 71/0036; A63B 71/0054; A63B 21/0724; A63B 2225/09; A63B 21/4045; A63B 2225/093

See application file for complete search history.

(56) References Cited

U.S. PATENT DOCUMENTS 1,820,372 A * 8/1931 Blomquist ..... A63B 22/001 482/62
4,836,535 A * 6/1989 Pearson ..... A63B 21/154 482/106

(Continued)

*Primary Examiner* — Andrew S Lo
*Assistant Examiner* — Andrew M Kobylarz
(74) *Attorney, Agent, or Firm* — Alston & Bird LLP

(57) ABSTRACT

A power rack attachment system and associated method are provided. An example of the power rack attachment system includes a hand crank and a gearbox coupled to the hand crank, the gearbox comprising a plurality of gears connected to a lead screw, wherein the plurality of gears causes the lead screw to rotate in a vertical translation based on a radial motion of the plurality of gears. The power rack attachment system includes a guide housing connected to the gearbox, the guide housing comprising the lead screw, a vertically translating nut, and a guide rod, wherein the lead screw is connected to the vertically translating nut, such that rotation of said lead screw leads to vertical translation of said vertically translating nut. The power rack attachment includes a j-cup connected to the vertically translating nut, wherein the vertical translation of the vertically translating nut causes vertical translation of said j-cup.

19 Claims, 5 Drawing Sheets

(56) References Cited

U.S. PATENT DOCUMENTS

| | | | | |
|---|---|---|---|---|
| 5,050,866 | A * | 9/1991 | Fucci | A63B 69/222 473/483 |
| 6,149,556 | A * | 11/2000 | Jordan | A63B 71/0036 482/106 |
| 9,895,572 | B2 * | 2/2018 | Donato | A63B 21/0726 |
| 2008/0070759 | A1 * | 3/2008 | Chaulk | A63B 21/078 482/104 |
| 2021/0362021 | A1 * | 11/2021 | Reed | A63B 71/023 |

* cited by examiner

MODULAR POWER RACK ATTACHMENT FOR FACILITATING LOADED BARBELL HEIGHT ADJUSTMENT

INCORPORATION BY REFERENCE

This application claims priority to and the benefit of U.S. Provisional Patent Application No. 63/201,366, filed Apr. 26, 2021; the entire contents of which are hereby incorporated by referenced herein.

BACKGROUND

Related Field

Various embodiments of the present invention relate to a power rack attachment assembly for a loaded barbell height adjustment and a method for providing a power rack attachment. Applicant has identified a number of deficiencies and problems associated with present systems and methods of loaded barbell height adjustment that limit safety, efficiency, and accuracy in adjusting the height of a loaded barbell. Through applied effort, ingenuity, and innovation, many of these identified problems have been solved by developing solutions that are included in embodiments of the present disclosure, many examples of which are described in detail herein.

Description of Related Art

Barbell height adjustment is already a difficult task to complete for an individual wishing to safely, efficiently, and accurately, position a barbell during a session on a power rack and/or a squat rack. For instance, barbell adjustment requires a user of a power rack to adjust the barbell by removing the barbell from the power rack and manually changing the height of the power rack's attachment which holds the barbell, such as a j-cup. This problem is exacerbated when a user's barbell comprises weights and/or plates on each end.

For instance, in the instance where a user's barbell comprises weights and/or plates on each end, a user may be required to manually remove each weight from the barbell before a height adjustment may be made on the power rack. Such a requirement may lead to heightened risks in safety as the user removes each weight and/or plate, a lower efficiency in a user's time to work out, and/or accuracy in reloading the barbell once the heights have been adjusted (e.g., a user may lose track of one of the weights and/or plates to another user and may be unable to reload the same weight as before, the user may accidentally load improper weights and/or plates, and/or the user may accidentally load the weights and/or plates in the wrong order).

Some systems have attempted to cure the deficiencies in power rack adjustment without removing the weights and/or plates of a barbell, but create other issues in requiring a user to create a large amount of force to move the barbell, such as a combo rack attachment which requires a user to lift at least one side of each barbell higher than the desired height, or other power rack height adjustment systems which may require hydraulic additives, such as a hydraulic height adjustment system.

BRIEF SUMMARY

The present invention provides a safe and easy-to-use power rack attachment. In various embodiments, the power rack attachment comprises: a hand crank; a gearbox coupled to the hand crank, the gearbox comprising a plurality of gears connected to a lead screw, wherein the plurality of gears causes the lead screw to rotate in a vertical translation based on a radial motion of the plurality of gears; a guide housing connected to the gearbox, the guide housing comprising the lead screw, a vertically translating nut, and a guide rod, wherein the lead screw is connected to the vertically translating nut with the guide rod running through a hole in said vertically translating nut and along a length of said power rack attachment, such that rotation of said lead screw leads to a vertical translation of said vertically translating nut; and a j-cup connected to the vertically translating nut, wherein the vertical translation of the vertically translating nut causes vertical translation of said j-cup.

In some embodiments, the power rack attachment's gearbox or the guide housing comprises a peg inserted into a hole of the power rack design.

In some embodiments, the power rack attachment's gearbox or guide housing comprises a perpendicular portion to grip a vertical pole of a power rack design.

In some embodiments, the power rack attachment's plurality of gears comprises a plurality of bevel gears, wherein at least one bevel gear of the plurality of gears is in a perpendicular position to a second bevel gear of the plurality of gears.

In some embodiments, the power rack attachment's plurality of gears comprises a first miter gear that meshes perpendicularly to a second miter gear, wherein the second miter gear is connected to said lead screw.

In some embodiments, the power rack attachment's gearbox further comprises a plurality of bearings. In some embodiments, the power rack attachment's plurality of bearings comprises at least one of a ball bearing or a radial load bearing. In some embodiments, the power rack attachment's radial load bearing is positioned between the hand crank and a gear of the plurality of gears in an instance where the plurality of bearings comprises a radial load bearing.

In some embodiments, the power rack attachment's hand crank is detachable from the gearbox.

In some embodiments, the power rack attachment's guide housing comprises at least one of a thrust load bearing or a radial load bearing.

In some embodiments, the power rack attachment's guide housing comprises a covering around said lead screw, said vertically translating nut, and said guide rod, and wherein the guide housing further comprises an open track for the vertical translation of the j-cup.

In some embodiments, a power rack attachment method is provided, wherein the power rack attachment method comprises: providing a hand crank; providing a gearbox coupled to the hand crank, the gearbox comprising a plurality of gears connected to a lead screw, wherein the plurality of gears cause the lead screw to rotate in a vertical translation based on a radial motion of the plurality of gears; providing a guide housing connected to the gearbox, the guide housing comprising the lead screw, a vertically translating nut, and a guide rod, wherein the lead screw is connected to the vertically translating nut with the guide rod running through a hole in said vertically translating nut and along a length of said power rack attachment, such that rotation of said lead screw leads to vertical translation of said vertically translating nut; and providing a j-cup connected to the vertically translating nut, wherein the vertical translation of the vertically translating nut causes vertical translation of said j-cup.

In some embodiments, the power rack attachment method's gearbox or guide housing comprises a peg inserted into a hole of the power rack design.

In some embodiments, the power rack attachment method's gearbox or guide housing comprises a perpendicular portion to grip a vertical pole of a power rack design.

In some embodiments, the power rack attachment method's plurality of gears comprises a plurality of bevel gears, wherein at least one bevel gear of the plurality of gears is in a perpendicular position to a second bevel gear of the plurality of gears.

In some embodiments, the power rack attachment method's plurality of gears comprises a first miter gear that meshes perpendicularly to a second miter gear, wherein the second miter gear is connected to said lead screw.

In some embodiments, the power rack attachment method's gearbox further comprises a plurality of bearings. In some embodiments, the power rack attachment method's plurality of bearings comprises at least one of a ball bearing or radial load bearing. In some embodiments, the power rack attachment method's radial load bearing is positioned between the hand crank and a gear of the plurality of gears in an instance where the plurality of bearings comprises a radial load bearing.

In some embodiments, the power rack attachment method's guide housing comprises at least one of a thrust load bearing or a radial load bearing.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the disclosure in any way. It will be appreciated that the scope of the present disclosure encompasses many potential embodiments in addition to those here summarized, some of which will be further described below.

BRIEF DESCRIPTION OF THE SEVERAL VIEWS OF THE DRAWINGS

Figure 1:
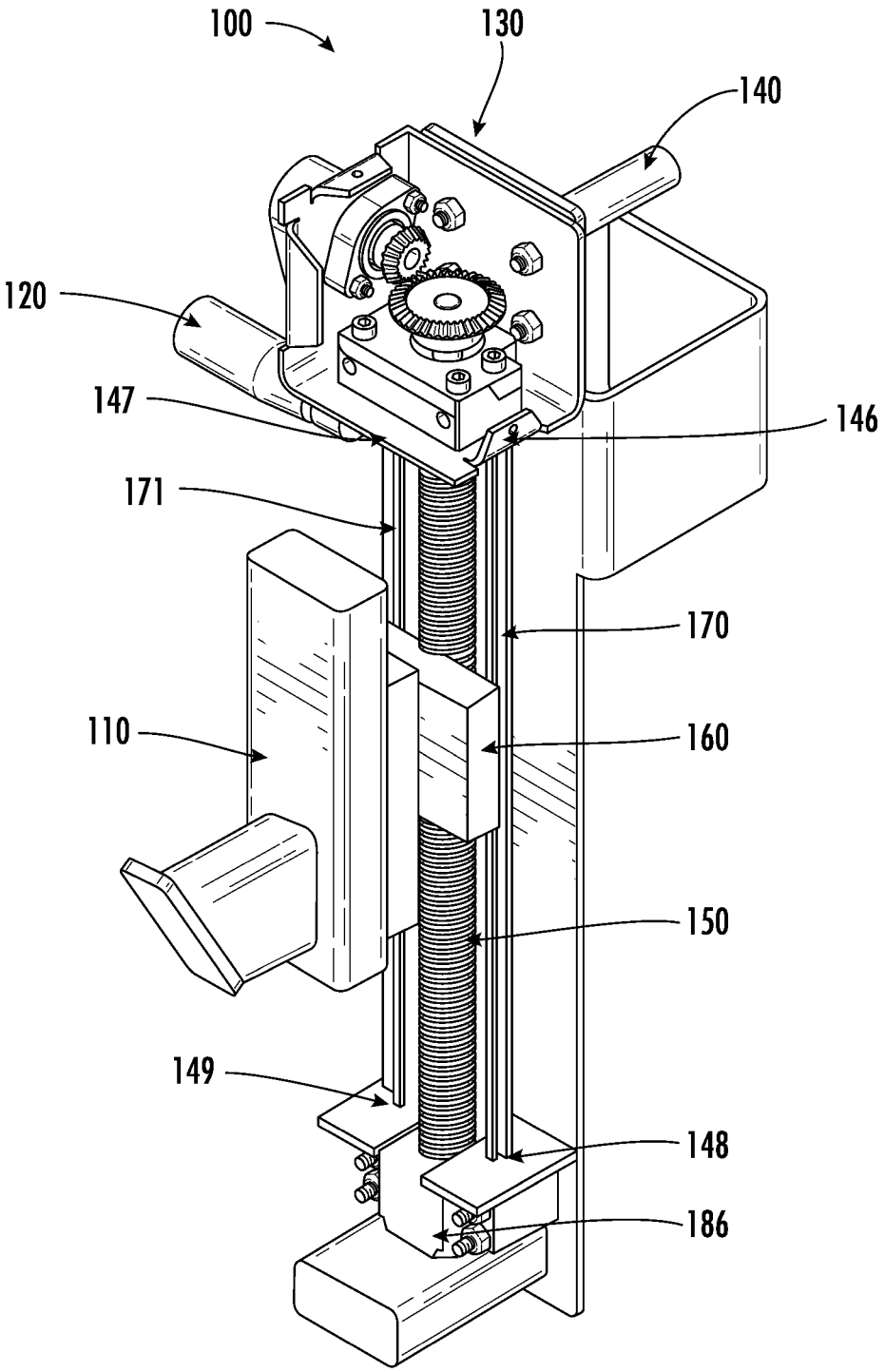
Figure 2:
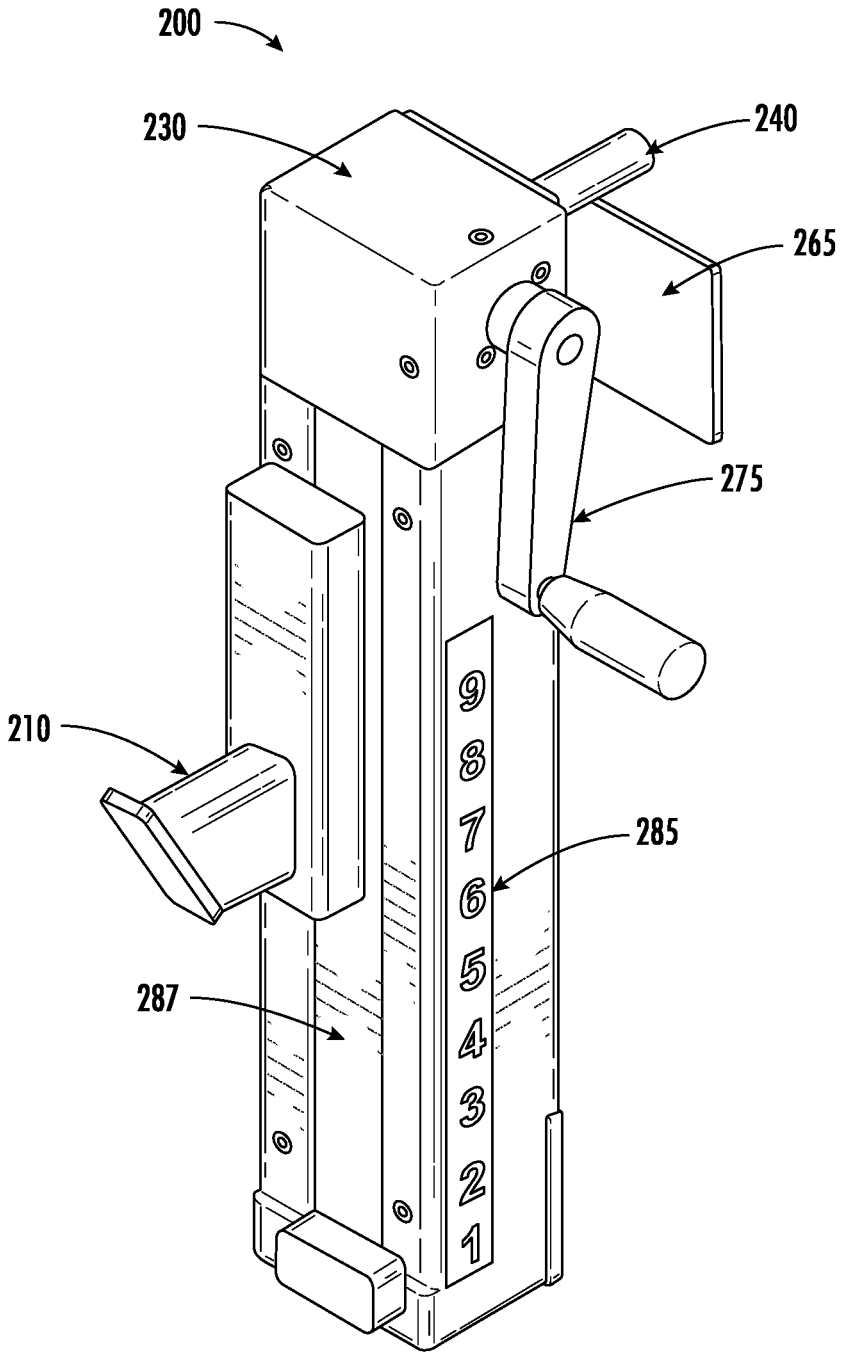
Figure 3:
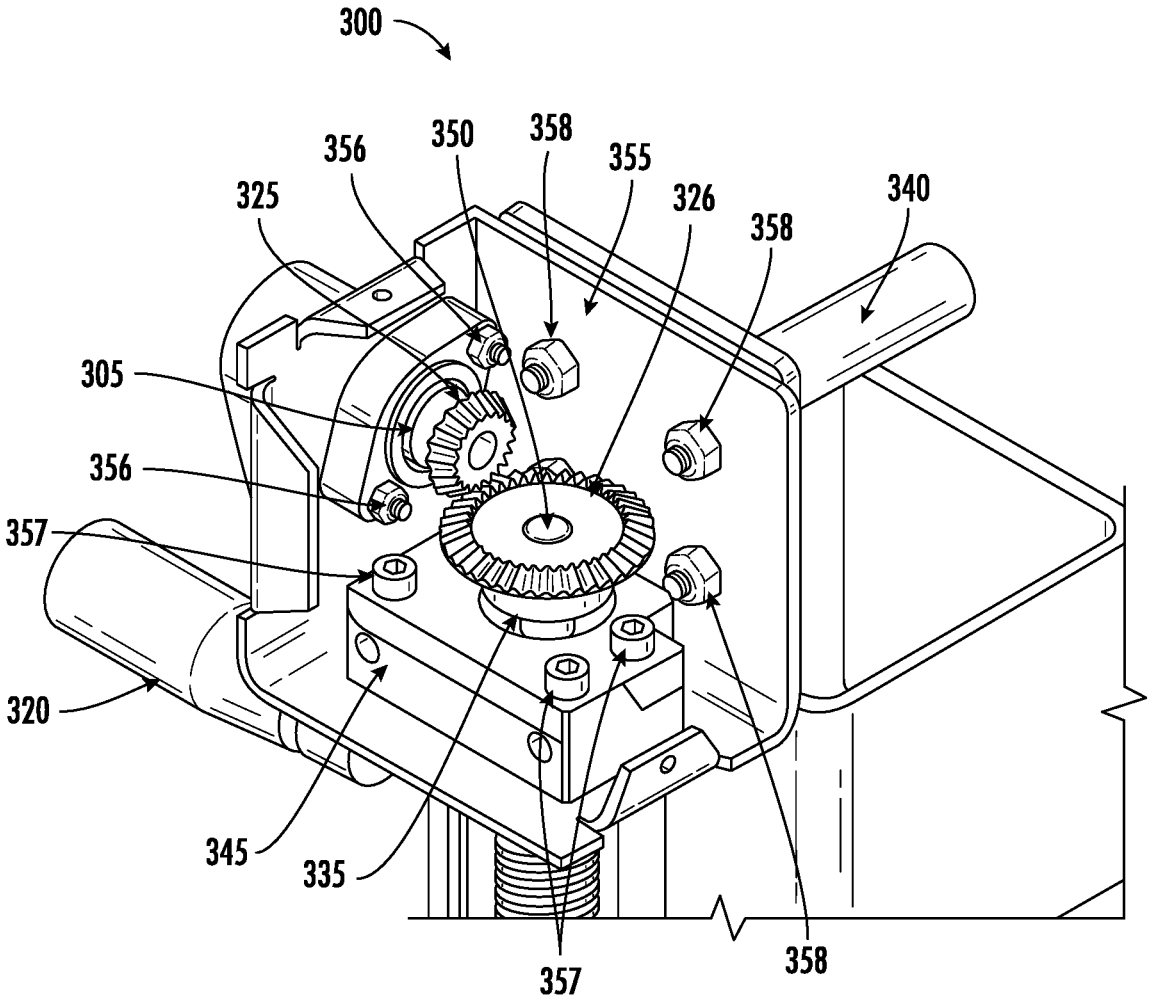
Figure 4:
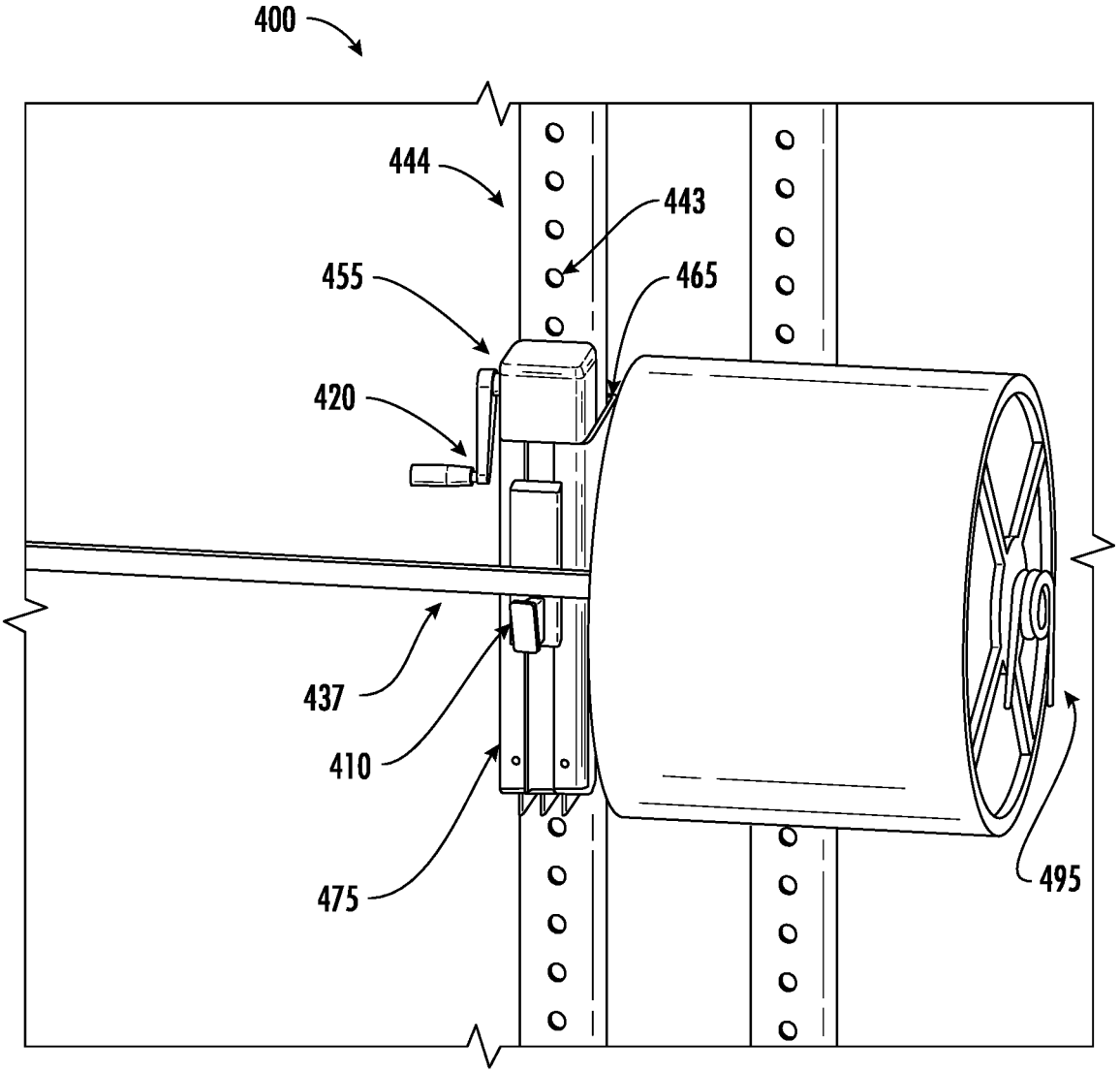
Figure 5:
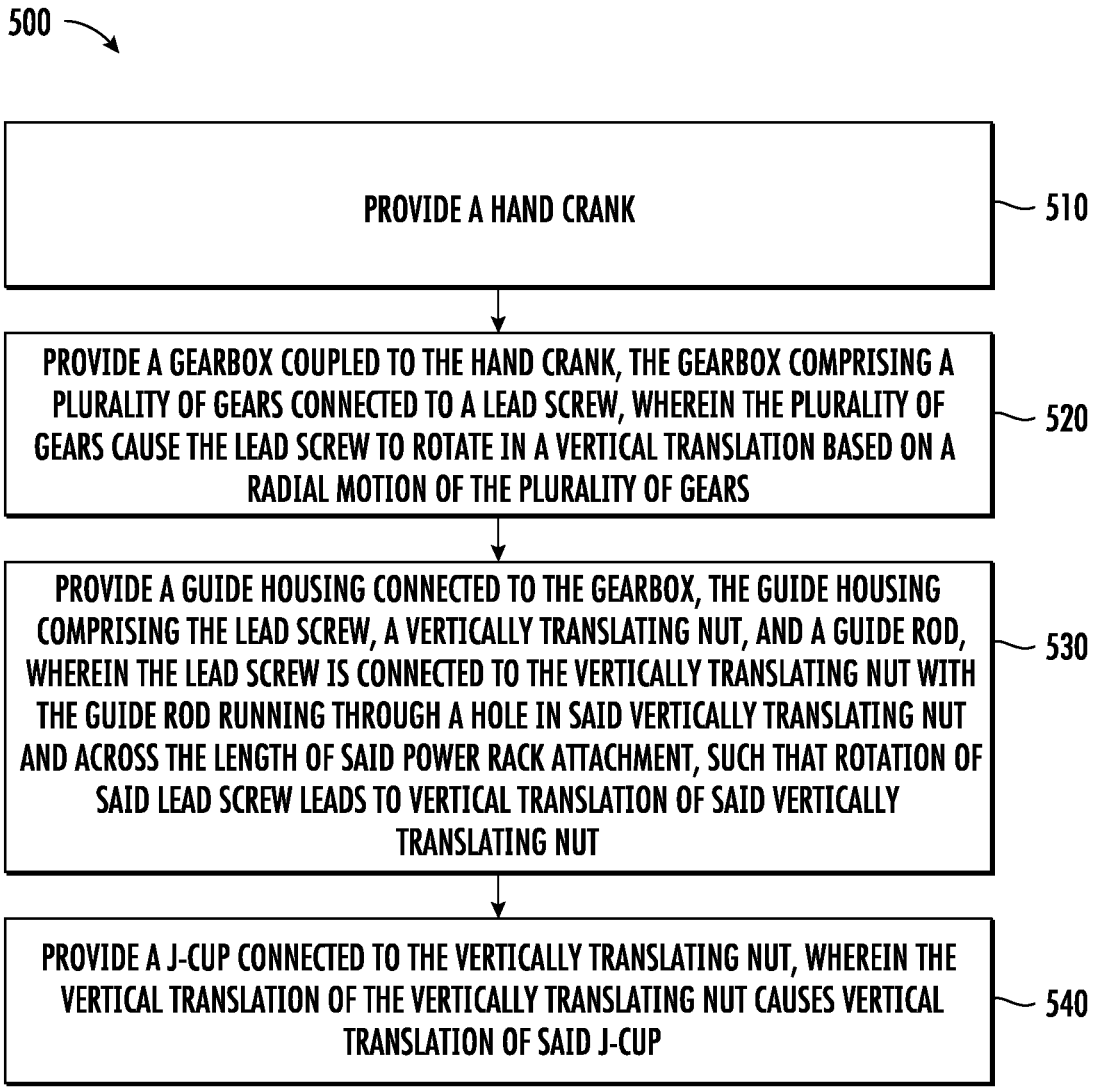

Having thus described the invention in general terms, reference will now be made to the accompanying drawings, which are not necessarily drawn to scale, and wherein:

FIG. 1 depicts an example power rack attachment system in accordance with one or more embodiments of the present invention;

FIG. 2 depicts an example power rack attachment system and the associated housings, which are described in more detail herein, in accordance with one or more embodiments of the present invention;

FIG. 3 is an expanded illustration of an example gearbox of the power rack attachment in accordance with one or more embodiments of the present invention;

FIG. 4 depicts an illustration of a power rack attachment in an exemplary use with a weighted barbell in accordance with one or more embodiments of the present invention; and FIG. 5 depicts an exemplary method of providing a power rack attachment in accordance with one or more embodiments of the present invention.

DETAILED DESCRIPTION OF VARIOUS EMBODIMENTS

Embodiments of the present disclosure now will be described more fully hereinafter with reference to the accompanying drawings in which some but not all embodiments are shown. Indeed, the present disclosure may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances. The term "or" is used herein in both the alternative and conjunctive sense, unless otherwise indicated.

Still further, to facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

FIG. 1 and FIG. 2 depict example embodiments of a power rack attachment system according to some example embodiments. It will be appreciated that the systems 100 and 200, as well as the illustrations in other figures, are each provided as an example of embodiments and should not be construed to narrow the scope or spirit of the disclosure in any way. In this regard, the scope of the disclosure encompasses many potential embodiments in addition to those illustrated and described herein. As such, while FIG. 1 and FIG. 2 illustrate example configurations of a system for a power rack attachment, numerous other configurations may also be used to implement embodiments of the presentation invention.

The system of FIG. 1 and FIG. 2 include a j-cup 110 (and likewise shown as 210 of FIG. 2), hand crank 120, gearbox 130 (and likewise shown as gearbox 230 of FIG. 2), peg 140 and 240 (e.g., a peg that is inserted into a power rack design), lead screw 150, vertically translating nut 160, guide rods 170 and 171, bearing housing 186 (e.g., which may comprise a radial load bearing and a thrust load bearing), a guide housing 275 (e.g., which may comprise the components of the lead screw 150, vertically translating nut 160, guide rod 170, and bearing housing 186), a plurality of height markers 285, and a plurality of bristles 287.

In some embodiments, a hand crank 120 may be used as part of the power rack attachment. By way of non-limiting example, the hand crank 120 may be used by a user of the power rack attachment to turn a plurality of bearings and/or gears in the power rack attachment, such as those gears that may be found within the gearbox 130 of the power rack attachment. For instance, the gears of the gearbox may comprise bevel gears like that shown as bevel gears 325 and 326 of FIG. 3, which are described in more detail below.

In some embodiments, the gearbox 130 (which is likewise shown as gearbox 230) may take the torque provided by the hand crank 120, convert it to a radial torque through the use of a plurality of gears, such as the bevel gears 325 and 326, which are connected to the hand-crank, and convert the radial torque into a vertical motion to move a lead screw 150 within the guide housing 275.

In some embodiments, and once the radial torque has been converted to a vertical motion to move the lead screw 150, a vertically translating nut 160—attached and/or connected to the lead screw—may be moved vertically along the lead screw 150, which is likewise shown as a top-portion of the lead screw 350 in FIG. 3.

In some embodiments, a guide rods 170 and 171 may be implemented to run parallel to the lead screw 150 within the guide housing 275, such as that shown in FIG. 1. By way of non-limiting example, a portion of the housing of the vertically translating nut 160 may encircle, wrap around, and/or grip the lead screw 150 such that as the lead screw 150 turns, the vertically translating nut 160 only moves in a vertical translation (e.g., only moves in an up-or-down direction, without moving in a circular direction to follow the direction of the lead screw 150). In some embodiments, the guide rods 170 and 171 may be secured at both top and bottom locations of the power rack attachment, such as top locations 146 and 147 which is secured directly below the gearbox 130 and 230 (e.g., at the top of the guide housing 275 in a perpendicular position from the gearbox 130 and 230). By way of non-limiting example, the guide rods 170 and 171 may additionally be secured at a bottom location of the power rack attachment, such as the bottom locations 148 and 149 of the guide housing shown in FIG. 1, respectively.

In some embodiments, the power rack attachment may be implemented for use for a left-handed and/or a right-handed user. In some embodiments, the power rack attachment may be implemented for use for a specific side of a power rack design (e.g., a left side or a right side of a power rack). By way of non-limiting example, a lead screw 150 may comprise threading specific to each intended side of use (e.g., a right side of use or a left side) and the vertically translating nut 160 may mirror and/or match the threading of the lead screw 150, such that turning the hand crank in the same direction for each side causes the j-cup to move in the same direction (e.g., both a power rack attachment designed with a left hand crank and a power rack attachment designed with a right hand crank cause the same vertical translation of the j-cup for the same hand crank direction). In some embodiments, the hand crank 120 may be positioned on the inside of the power rack design, such that each hand crank 120 located on the power rack attachment(s) for a power rack are positioned toward the other hand crank 120 (e.g., positioned at internally to the sides of the power rack).

In some embodiments, a j-cup 110 may be attached to the vertically translating nut 160 as it vertically traverses the power rack attachment along the lead screw 150. For example, as the vertically translating nut 160 moves along the lead screw 150, the j-cup 110 moves in tandem with the vertically translating nut 160, which in turn may move a barbell placed within and/or on top of the j-cup 110. In some embodiments, such a j-cup 110 may be used to hold, grip, clench, support, and/or brace a barbell on a power rack design. In some embodiments, the j-cup may comprise a plurality of materials to support a barbell on a power rack, including but not limited to steel, sheet metal, titanium, and/or the like.

In some embodiments, the lead screw may be of a specified length and/or height to provide a vertical translation of the j-cup 110 along the length of the guide housing. In some embodiments, the length of the guide housing may comprise a length of 10 inches, may be shorter than 10 inches, and/or may be longer than 10 inches. In some embodiments, the length of the guide housing may be dependent on the height of the power rack design the power rack attachment is intended for use.

In some embodiments, the power rack attachment may further comprise a plurality of bearings within a bearing housing 186, such as a radial load bearing, which may be used within the power rack attachment to prevent friction, between the lead screw 150 and the guide housing 275 which holds the lead screw 150 in place. Further, and in some embodiments, the radial load bearing may further provide improved load bearing on the power rack attachment, such as the load provided by a weighted barbell.

In some embodiments, the power rack attachment may further comprise a second bearing within the bearing housing 186, and for which the second bearing may be a thrust load bearing. By way of non-limiting example, the thrust load bearing may be situated below a first bearing (e.g., a radial load bearing), and may act to support the axial thrust of the lead screw 150 from moving within the power rack attachment. In further embodiments, the thrust load bearing (e.g., the second bearing) may be used to transfer the loads applied to the power rack attachment, such as a load provided by a weighted barbell applied to the j-cup 110 and 210.

In some embodiments, the power rack attachment may further comprise a peg 240, which may be used by the power rack attachment to attach to a power rack design (i.e., a power rack). By way of non-limiting example, the peg 240 may be inserted into a plurality of holes on a power rack such as the hole 443 shown in FIG. 4 (which is described in further detail below). By way of non-limiting example, the peg 240 may be inserted into a hole of the power rack in order to secure the power rack attachment the pole (e.g., vertical pole 444 of FIG. 4) of a power rack. Once the peg 240 has been inserted into one of a plurality of holes in a pole of a power rack, the power rack attachment may be secured to the pole of the power rack in the vertical position of the selected hole.

Further, and in some embodiments, the power rack attachment may further comprise a perpendicular portion, such as an L-shaped attachment like that shown as perpendicular portion 265 of FIG. 2. By way of non-limiting example, the peg 240 may be inserted in a perpendicular position to the pole of the power rack (e.g., such that length of the power rack attachment is held away from or perpendicular to the pole of the power rack) and the power rack attachment, after peg 240 insertion, may be swung in a downward motion around (e.g., radially from the peg 240 inserted into the hole) to align parallel and flush with the pole of the power rack. In such embodiments, the L-shaped attachment (e.g., perpendicular portion) may secure the power rack attachment to the pole from a second degree of mobility, such as to keep the power rack attachment from moving outward toward the crank and/or the keep the power rack attachment from moving outward toward the front of the power rack (e.g., in the direction of the j-cup).

In some embodiments, the power rack attachment may be attached to the power rack (i.e., power rack design) by way of a slot attachment method. By way of non-limiting example, the peg 240 of the power rack attachment may be inserted into a slot of the vertical pole of the power rack and the perpendicular portion of the power rack may secure the power rack attachment to the pole by wrapping around and/or enveloping the vertical pole of the power rack on the inside of the power rack design, such that the perpendicular portions of two power rack attachments in use for a single power rack design face inward, toward the other perpendicular portion of the power rack attachment.

In some embodiments, the power rack attachment may further comprise a plurality of height guidance markings, such as that shown for markings 285. By way of non-limiting example, a user of the power rack attachment may rely on the markings 285 to indicate where the j-cup 110 and 210 sits in the power rack attachment and to gauge how high and/or how low to move the j-cup 110 and 210 within the power rack attachment, without moving the power rack attachment itself. By way of non-limiting example, a user of two power rack attachments—such as a user of a power rack which comprises a power rack attachment on both a left side of the power rack and a right side of the power rack—may use the markings 285 to align the position of the barbell shared between the two power rack attachments to generate a level barbell. By way of non-limiting example, if a power rack attachment on a right side of the power rack indicates the j-cup 110 and 210 is positioned at line 6, like that shown at marking 285, then a user of the power rack attachment of the left side of the power rack may use the hand crank 120 of the power rack attachment to move the j-cup 110 and 210 of the right side of the power rack to line 6.

In some embodiments, the power rack attachment may further comprise a plurality of bristles and/or the like to prevent a user, a user's extremities, and/or a user's belongings—such as a user's clothing—from interfering with the components of the guide housing (e.g., the lead screw, the vertically translating nut, the guide rod, and/or the like) within an open track of the guide housing (e.g., the opening of the guide housing that promotes the vertical translation of the j-cup 110 and 210). Such a plurality of bristles may also improve safety of a user of the power rack attachment by preventing a user from inserting their extremities and/or belongings into the guide housing.

FIG. 3 depicts an example embodiment of a gearbox of a power rack attachment system according to some example embodiments. It will be appreciated that the system 300 as well as the illustrations in other figures are each provided as an example of an embodiment and should not be construed to narrow the scope or spirit of the disclosure in any way. In this regard, the scope of the disclosure encompasses many potential embodiments in addition to those illustrated and described herein. As such, while FIG. 3 illustrate an example configuration of a system for a gearbox for a power rack attachment, numerous other configurations may also be used to implement embodiments of the presentation invention.

In some embodiments, a gearbox, such as that shown as an expanded gearbox 300 of FIG. 3, may comprise a plurality of bearings (e.g., bearing 305 and bearing 335), a bearing housing 345, a plurality of gears (e.g., gear 325 and gear 326), a crank handle 315, a gearbox housing 355, and/or a plurality of fasteners (e.g., fasteners 356, 357, and/or 358).

In some embodiments, and by way of non-limiting example, a gearbox may be attached to a hand crank 320 (likewise shown as 120 in FIG. 1), and a portion of the hand crank 320 may be attached to a plurality of gears (e.g., gear 325 and gear 326) within the gearbox housing 355. In some embodiments, the hand crank 320 may be attached to gear 325, itself, or it may comprise a hand crank attachment (not shown), which may be connected between the hand crank 320 and gear 325. In some embodiments, gear 325 may comprise and/or may be a bevel gear. In some embodiments, the gear 325 may be fastened to the gearbox 355 by way of a plurality of fasteners, such as fasteners 356, wherein fasteners 356 may comprise at least two M4 fasteners on each side of gear 325.

In some embodiments, the hand crank 320 may be permanently affixed to the gearbox housing 355 or the hand crank 320 may be detachable from the gearbox housing 355.

In some embodiments, the gearbox housing 355 may be affixed to a peg 340 for insertion into a power rack via a peg in a slot. The affixing of the gearbox 355 to the peg and/or a backplate housing the peg 340 may be accomplished through the use of a plurality of fasteners (e.g., fasteners 358), wherein fasteners 358 may comprise two M6 fasteners.

In some embodiments, the gearbox housing 355 may further comprise a first bearing 305, such as a ball bearing, connected to a first gear (e.g., gear 325), the first gear being the gear closest to the hand crank 320. By way of non-limiting example, the radial load bearing may act to reduce friction between the hand crank 320 (and/or the hand crank attachment) and gear 325. Additionally, or alternatively, the radial load bearing may allow for rotation of the hand crank 320 of the power rack attachment. In some embodiments, the radial load bearing may be permanently lubricated, such as by an oil-based polymer.

In some embodiments, the gearbox housing 355 further comprises a second gear 326 which may be used within the gearbox housing 355 and may be used to transfer the radial torque provided by the hand crank 320 into a vertical motion—that is connected to one of the plurality of gears (e.g., the second gear 326 of the plurality of gears, the second gear 326 being positioned on top of a lead screw 150)—to turn the lead screw 150. The gear 326, which is housed within the gearbox, may comprise a bevel gear and/or miter gear, wherein the first bevel gear and/or miter gear 325 is positioned (e.g., meshes) at an angle to the second bevel gear and/or miter gear 326, such as at a 90-degree angle (i.e., a perpendicular position). Such an angle of the bevel gears/miter gears may also comprise an angle greater than 90 degrees (e.g., a degree anywhere between 90 degrees to 180 degrees, not including 180 degrees) and/or a degree lesser than 90 degrees (e.g., a degree anywhere between 0 degrees and 90 degrees, not including 0 degrees). The use of such bevel gears as the plurality of gears (e.g., gear 325 and gear 326) in the gearbox may be used to produce an increased output torque between the hand crank 320 and the lead screw 150.

In some embodiments, the bevel gear(s) and/or miter gear(s) of the plurality of gears may allow a barbell and a barbell's attached weight and/or disks to be used on the power rack attachment at a maximum of 2,250 lbs. In some embodiments, the maximum load based on the power rack attachment and its components (e.g., the plurality of gears such as the bevel gear(s) and/or miter gear(s)) may be at any amount between 500 lbs. and 2,250 lbs.

In some embodiments, the gearbox housing 355 may further comprise a second gear 335, which may be a radial load bearing. By way of non-limiting example, the second bearing 335 (e.g., radial load bearing) may be situated below a second bearing of the plurality of bearings 335 (e.g., a second bevel gear) and may act to reduce friction between the second bearing 335 (e.g., radial loadbearing) as it moves and a bearing housing 345 and/or lead screw 150.

In some embodiments, the gearbox housing 355 may comprise a plurality of materials, including but not limited to sheet metal, aluminum, titanium, and/or the like. Likewise, and in some embodiments, the guide housing 275 may be of a similar material to the gearbox housing and/or may be of a different material, but may comprise at least one of sheet metal, aluminum, titanium, and/or the like. In some embodiments, a backplate of the power rack attachment (e.g., the portion of the power rack attachment directly parallel and/or adjacent to the pole of the power rack attachment) may comprise a plurality of materials including materials of a high strength such as sheet metal, titanium, and/or the like.

In some embodiments, the lead screw 150 may comprise a top-most portion that is situated within the second bearing of the plurality of bearings (e.g., radial load bearing) such that as the second bearing (e.g., radial load bearing) circulates, the lead screw circulates in the same direction and at the same speed. In some embodiments, the top-most portion of the lead screw 150 is situated directly below the second bearing 335 (e.g., radial load bearing) and is connected to the second bearing 335 by the bearing housing 345. In some embodiments, the bearing housing may be affixed to the gearbox housing 355 by a plurality of fasteners 357, wherein fasteners 357 may comprise four M5 fasteners to attach the bearing housing 345 to the gearbox housing 355.

FIG. 4 depicts an example embodiment of a power rack attachment system attached to a power rack during an exemplary use, according to some example embodiments. It will be appreciated that the system 400 as well as the illustrations in other figures are each provided as an example of an embodiment(s) and should not be construed to narrow the scope or spirit of the disclosure in any way. In this regard, the scope of the disclosure encompasses many potential embodiments in addition to those illustrated and described herein. As such, while FIG. 4 illustrate an example configuration of a system for a power rack attaching being used by an exemplified power rack, numerous other configurations may also be used to implement embodiments of the presentation invention.

In some embodiments, the power rack attachment described in detail herein may be used in conjunction with a power rack like that shown in FIG. 4. By way of non-limiting example, the power rack attachment may comprise a hand crank 420, gearbox 455, perpendicular portion 465, guide housing 475, peg (not pictured), and/or a j-cup 410. By way of non-limiting example, the power rack attachment and its assorted components (e.g., and crank 420, gearbox 455, perpendicular portion 465, guide housing 475, peg, and/or a j-cup 410) may be used to attach to a pole 444 of a power rack by way of insertion of the peg into at least one of a plurality of holes (e.g., hole 443) of the pole 444, and for which the perpendicular portion 465 may be used by the power rack attachment for further securement to the pole 444. In some embodiments, once the power rack attachment has been secured to the power rack and its pole 444, a barbell 437 may be placed on the j-cup 410 and weights and/or disks 495 may be secured on the barbell for weightlifting. In some embodiments, the hand crank 420 may be turned in order to vertically translate (e.g., move up and/or down) the j-cup 410 holding the weighted and/or unweighted barbell 437.

FIG. 5 depicts an example method of providing a power rack attachment process. The method (e.g., method 500) may include the step of providing a hand crank at operation 510. As described above, the hand crank may be configured to receive a torque from a user of the power rack attachment, convert the torque of the user to a plurality of gears within a gearbox, and further convert the torque provided by the gearbox to a lead screw to vertically translate a j-cup connected to a lead screw. As described above, the hand crank may be permanently affixed to the gearbox and/or may be detachable from the gearbox.

The method (e.g., method 500) may include the step of providing a gearbox coupled to the hand crank, the gearbox comprising a plurality of gears connected to a lead screw, wherein the plurality of gears causes the lead screw to rotate in a vertical translation based on a radial motion of the plurality of gears, at operation 520. As described above, the power rack attachment's gearbox may comprise a plurality of gears (e.g., bevel gear(s) and/or miter gear(s)), and/or bearing(s) (e.g., ball bearing and/or radial load bearing), and may including a bearing housing. By way of non-limiting example, and as described in detail herein, when a hand crank is turned, like the hand crank attached to the gearbox, a torque is provided to the plurality of gears (e.g., bevel gear(s) and/or miter gear(s)) and converted from a radial torque to a vertical motion to turn a lead screw within a guide housing.

The method (e.g., method 500) may further include the step of providing a guide housing connected to the gearbox, the guide housing comprising the lead screw, a vertically translating nut, and a guide rod, wherein the lead screw is connected to the vertically translating nut with the guide rod running through a hole in said vertically translating nut and along the length of said power rack attachment, such that rotation of said lead screw leads to vertical translation of said vertically translating nut, at operation 530. By way of non-limiting example, and as described above, a guide housing is provided which comprises a plurality of components (e.g., a lead screw, a vertically translating nut, a guide rod, a plurality of bearings—such as a radial load bearing and/or a thrust load bearing—and a j-cup). By way of non-limiting example, and as described in detail above, as the plurality of gears (e.g., bevel gear(s) and/or miter gear (s)) within the gearbox are moved, the attached lead screw is moved in a circular motion to match the second gear of the plurality of gears moves. In some embodiments, a vertically translating nut—which is attached and/or connected to the lead screw—moves up and down the lead screw but retains its position outward toward the attached j-cup by way of a guide rod that runs parallel to the lead screw.

The method (e.g., method 500) may further include the step of providing a j-cup connected to the vertically translating nut, wherein the vertical translation of the vertically translating nut causes vertical translation of said j-cup, at operation 540. By way of non-limiting example, as the lead screw is turned, a vertically translating nut moves up or down the lead screw, and a j-cup attached to the vertically translating nut moves in the similar or same manner.

Many modifications and other embodiments of the inventions set forth herein will come to mind to one skilled in the art to which these inventions pertain having the benefit of the teachings presented in the foregoing descriptions and the associated drawings. Although the figures only show certain components of the methods and systems described herein, it is understood that various other components may also be part of the power rack attachment system. Modifications to the steps of the method described above, in some cases, may be performed in any order and in any combination.

Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A power rack attachment comprising:

a hand crank;

a gearbox coupled to the hand crank, the gearbox comprising a plurality of gears connected to a lead screw, wherein the plurality of gears causes the lead screw to rotate in a vertical translation based on a radial motion of the plurality of gears;

a guide housing connected to the gearbox, the guide housing comprising the lead screw, a vertically translating nut, and a guide rod, wherein the lead screw is connected to the vertically translating nut with the lead screw running through a hole in said vertically translating nut and along a length of said power rack attachment, such that rotation of said lead screw leads to a vertical translation of said vertically translating nut; and a j-cup connected to the vertically translating nut, wherein the vertical translation of the vertically translating nut causes vertical translation of said j-cup.

2. The power rack attachment of claim 1, wherein at least one of the gearbox or the guide housing comprises a peg inserted into a hole of a power rack design.

3. The power rack attachment of claim 1, wherein at least one of the gearbox or the guide housing comprises a perpendicular portion to grip a vertical pole of a power rack design.

4. The power rack attachment of claim 1, wherein the plurality of gears comprises a plurality of bevel gears, wherein at least one bevel gear of the plurality of gears is in a perpendicular position to a second bevel gear of the plurality of gears.

5. The power rack attachment of claim 1, wherein the plurality of gears comprises a first miter gear that meshes perpendicularly to a second miter gear, wherein the second miter gear is connected to said lead screw.

6. The power rack attachment of claim 1, wherein the gearbox further comprises a plurality of bearings.

7. The power rack attachment of claim 6, wherein the plurality of bearings comprises at least one of a ball bearing or a radial load bearing.

8. The power rack attachment of claim 7, wherein in an instance where the plurality of bearings comprises a radial load bearing, the radial load bearing is positioned between the hand crank and a gear of the plurality of gears.

9. The power rack attachment of claim 1, wherein the hand crank is detachable from the gearbox.

10. The power rack attachment of claim 1, wherein the guide housing comprises at least one of a thrust load bearing or a radial load bearing.

11. A power rack attachment method comprising:

providing a hand crank;

providing a gearbox coupled to the hand crank, the gearbox comprising a plurality of gears connected to a lead screw, wherein the plurality of gears cause the lead screw to rotate in a vertical translation based on a radial motion of the plurality of gears;

providing a guide housing connected to the gearbox, the guide housing comprising the lead screw, a vertically translating nut, and a guide rod, wherein the lead screw is connected to the vertically translating nut with the lead screw running through a hole in said vertically translating nut and along a length of said power rack attachment, such that rotation of said lead screw leads to vertical translation of said vertically translating nut; and providing a j-cup connected to the vertically translating nut, wherein the vertical translation of the vertically translating nut causes vertical translation of said j-cup.

12. The power rack attachment method of claim 11, wherein at least one of the gearbox or the guide housing comprises a peg inserted into a hole of a power rack design.

13. The power rack attachment method of claim 11, wherein at least one of the gearbox or the guide housing comprises a perpendicular portion to grip a vertical pole of a power rack design.

14. The power rack attachment method of claim 11, wherein the plurality of gears comprises a plurality of bevel gears, wherein at least one bevel gear of the plurality of gears is in a perpendicular position to a second bevel gear of the plurality of gears.

15. The power rack attachment method of claim 11, wherein the plurality of gears comprises a first miter gear that meshes perpendicularly to a second miter gear, wherein the second miter gear is connected to said lead screw.

16. The power rack attachment method of claim 11, wherein the gearbox further comprises a plurality of bearings.

17. The power rack attachment method of claim 16, wherein the plurality of bearings comprises at least one of a ball bearing or radial load bearing.

18. The power rack attachment method of claim 17, wherein in an instance where the plurality of bearings comprises a radial load bearing, the radial load bearing is positioned between the hand crank and a gear of the plurality of gears.

19. The power rack attachment method of claim 11, wherein the guide housing comprises at least one of a thrust load bearing or a radial load bearing.

* * * * *